US011473170B2

(12) United States Patent
Asadrokht et al.

(10) Patent No.: US 11,473,170 B2
(45) Date of Patent: Oct. 18, 2022

(54) TREATMENT OF NON-SULFIDIC NICKELIFEROUS RESOURCES AND RECOVERY OF METAL VALUES THEREFROM

(71) Applicants: Mohammad Asadrokht, Tehran (IR); Alireza Zakeri, Tehran (IR)

(72) Inventors: Mohammad Asadrokht, Tehran (IR); Alireza Zakeri, Tehran (IR)

( * ) Notice: Subject to any disclaimer, the term of this patent is extended or adjusted under 35 U.S.C. 154(b) by 1064 days.

(21) Appl. No.: 16/137,365

(22) Filed: Sep. 20, 2018

(65) Prior Publication Data

US 2019/0024211 A1 Jan. 24, 2019

Related U.S. Application Data

(60) Provisional application No. 62/562,502, filed on Sep. 25, 2017.

(51) Int. Cl.

| | |
|---|---|
| ***C22B 3/06*** | (2006.01) |
| ***C22B 3/00*** | (2006.01) |
| ***C22B 23/00*** | (2006.01) |

(52) U.S. Cl.

CPC ..... *C22B 23/0415* (2013.01); *C22B 3/06* (2013.01); *C22B 23/005* (2013.01); *C22B 23/0446* (2013.01)

(58) Field of Classification Search

CPC ..... C22B 23/005; C22B 23/0415; C22B 23/0446; C22B 3/06

USPC ..... 75/743

See application file for complete search history.

(56) References Cited

U.S. PATENT DOCUMENTS

| | | | | |
|---|---|---|---|---|
| 7,387,767 | B2 | 6/2008 | Campbell et al. | |
| 9,481,919 | B2 * | 11/2016 | Liu | C22B 23/0484 |
| 2006/0002835 | A1 | 1/2006 | Neudorf | |
| 2011/0072936 | A1 * | 3/2011 | Narisako | C22B 26/12 75/403 |
| 2012/0204680 | A1 * | 8/2012 | Duyvesteyn | C22B 23/0453 423/139 |

FOREIGN PATENT DOCUMENTS

| | | | |
|---|---|---|---|
| CN | 100402679 | C | 7/2008 |
| RU | 2568223 | C2 | 11/2015 |

OTHER PUBLICATIONS

Fatahi Mohammadreza, Noaparast Mohammad, Shafaei Seyyed Ziaeddin, Nickel extraction from low grade laterite by agitation leaching at atmospheric pressure, International Journal of Mining Science and Technology, 24 (2014) 543-548.

(Continued)

*Primary Examiner* — Jie Yang

(74) *Attorney, Agent, or Firm* — Bajwa IP Law Firm; Haris Zaheer Bajwa

(57) ABSTRACT

A process for nickel concentration and extraction from non-sulfidic iron-bearing nickeliferous resources is disclosed. The process includes an atmospheric acid-based leaching treatment of the non-sulfidic iron-bearing nickeliferous resources by oxalic acid to produce a nickel concentrate comprising distinct nickel oxalate particles. The nickel concentrate is technically amenable to further chemical and physical processing to obtain various high-grade nickel products.

20 Claims, 13 Drawing Sheets

(56) References Cited

OTHER PUBLICATIONS

Dmitri S.Terekhov, Nanthakumar Victor Emmanuel, Direct extraction of nickel and iron from laterite ores using the carbonyl process, Minerals Engineering, 54 (2013) 124-130.

D.Q.Zhu, Y.Cui, K.Vining, S.Hapugod, J.Douglas, J.Pan, G.L. Zheng, Upgrading low nickel content laterite ores using selective reduction followed by magnetic separation, International Journal of Mineral Processing, 106-109 (2012) 1-7.

* cited by examiner

TREATMENT OF NON-SULFIDIC NICKELIFEROUS RESOURCES AND RECOVERY OF METAL VALUES THEREFROM

CROSS REFERENCE TO RELATED APPLICATION

This application claims priority from pending U.S. Provisional Patent Application Ser. No. 62/562,502, filed on Sep. 25, 2017, entitled "TREATMENT OF NICKELIFEROUS OXIDIC RESOURCES AND RECOVERY OF METAL VALUES THEREFROM", which is incorporated by reference herein in its entirety.

TECHNICAL FIELD

The present disclosure generally relates to the treatment of non-sulfidic nickeliferous resources, particularly to the hydrometallurgical upgrading of non-sulfidic iron-bearing nickeliferous resources and recovery of metal values therefrom, and more particularly to a process for concentration and extraction of nickel from non-sulfidic iron-bearing nickeliferous resources using a hydrometallurgical technique.

BACKGROUND

Continuous utilization of high-grade ore deposits especially nickel laterites has led to the depletion of high-grade resources and remaining low level of metal values in the existing resources. In addition, due to the ever-increasing demand for strategic metals such as nickel, developing new metallurgical processes for recovery of metal values from low-grade ores such as low-grade nickel laterites, finding other sources of metals, as well as, recovering metals from these new sources are of great interest metallurgists.

Nickel-containing ores generally include sulfidic and oxidic resources. About 70 percent of the worldwide nickel deposits are classified as laterites and the remaining 30 percent as sulfides, however, laterites currently account for less than half of the global nickel production. Nickel laterites are classified into two forms of high magnesium saprolitic and high iron limonitic ores. The established methods for extraction of nickel from saprolitic laterites (containing about 1.5-3 wt % Ni) include pyrometallurgical techniques of ferronickel production and nickel matte smelting, while limonitic ones (containing about 1-1.5 wt % Ni) are treated by hydrometallurgical techniques such as Caron process and high-pressure acid leaching. However, the applicability of the established pyrometallurgical or hydrometallurgical techniques can be limited since nickel recovery from the low-grade laterites is difficult due to their complex mineralogy. Technically, the above-described techniques cannot be applicable to low-grade laterites (<1 wt % Ni) mainly due to their high iron to nickel ratio. In addition, as nickel in laterite ores is found in solid solution with iron (III) oxides/hydroxides or with silicates, it cannot be selectively separated and concentrated by ore dressing techniques. Economically, it can be very cost-intensive and energy-intensive to recover nickel from low-grade laterites by conventional metallurgical techniques.

Most of the nickel production units only provide physical upgrading of nickel laterites through the most common pre-concentration process in which finer particles with higher nickel content are separated from the coarser ones with lower nickel content. In this regard, unlike the nickel sulfides, processing of the laterites to recover nickel by the established physical upgrading techniques to form a concentrate is limited. In other words, physical separation techniques including sizing and classification as well as gravity and magnetic separation either individually or in combination cannot be able to dramatically increase the grade of nickel laterite.

An applicable route for treating low-grade nickel bearing resources specially laterites can be atmospheric acid leaching process. Inorganic acids are the first candidates for nickel extraction with high recovery percent from nickel bearing resources; however, they have severe economic and technical engineering problems. For example, although sulfate-based atmospheric leaching can be conducted at low temperature and in open vessels, two key issues are the slow kinetic of nickel extraction and the presence of soluble iron in the leachate solution that needs to be processed subsequently. Chloride-based atmospheric leaching can also suffer from two issues including corrosion precautions of the chloride medium and high cost of hydrochloric acid.

Hence, developing a new and an effective metallurgical process to be applicable for concentration of nickel with high recovery percent from low-grade nickel-bearing resources especially from all layers of laterite ores, as well as, producing a high-grade nickel product using an atmospheric and organic acid-based leaching would be of great benefit. In addition, developing such a process for nickel recovery can lead to an increase in the exploitable mineral resources and consequently a decrease in the loss of nickel in the process waste.

SUMMARY

This summary is intended to provide an overview of the subject matter of this patent, and is not intended to identify essential elements or key elements of the subject matter, nor is it intended to be used to determine the scope of the claimed implementations. The proper scope of this patent may be ascertained from the claims set forth below in view of the detailed description below and the drawings.

In one general aspect, the present disclosure is directed to an exemplary process to extract a high-grade nickel from at least one non-sulfidic nickeliferous material. The process may include reducing particle size of the at least one non-sulfidic nickeliferous material by crushing the at least one non-sulfidic nickeliferous material, wherein the at least one non-sulfidic nickeliferous material including at least one primary or secondary non-sulfidic iron-bearing nickeliferous resource in oxide, hydroxide, carbonate, and silicate forms, forming a first pulp including a first solid residue and a first leachate solution by acid leaching of the crushed non-sulfidic nickeliferous material including extracting more than 96% of iron present in the non-sulfidic nickeliferous material by leaching with an organic acid-based solution, the organic acid-based solution including an oxalic acid solution, winning a nickel concentrate from the first pulp or separating the first solid residue from the first leachate solution, forming a second solid residue and a second leachate solution including a nickel-rich solution by ammoniacal leaching of the nickel concentrate or the first solid residue with an ammoniacal solution, separating the second leachate solution from the second solid residue, and recovering a high-grade nickel including a nickel oxalate product with a grade of more than 97 wt % from the second leachate solution.

The above general aspect may have one or more of the following features. In an exemplary implementation, the at least one primary or secondary non-sulfidic iron-bearing nickeliferous material may include chromite overburdens, poly-metallic sea nodules and laterites particularly low-grade nickel laterite ores. In an exemplary implementation, forming the first pulp including the first solid residue and the first leachate solution by acid leaching of the crushed non-sulfidic nickeliferous material includes extracting more than 96% of iron present in the non-sulfidic nickeliferous material by leaching with an organic acid-based solution, the organic acid-based solution including an oxalic acid solution, and an atmospheric acid leaching at a temperature lower than 90° C. for a duration more than 20 hours under a restricted light condition. Furthermore, in an exemplary implementation, winning the nickel concentrate from the first pulp may include obtaining the nickel concentrate including more than 91 wt % of nickel from the at least one non-sulfidic nickeliferous material by physically separating coarse fraction of particles in the first pulp from fine fraction using one or more of wet sieve, hydrosizer, or hydrocyclone. In an exemplary implementation, winning the nickel concentrate from the first pulp may include obtaining the nickel concentrate, including more than 91 wt % of nickel from the at least one non-sulfidic nickeliferous material, as an intermediate product free from iron (II) oxalate residue. In an exemplary implementation, winning the nickel concentrate from the first pulp comprises obtaining the nickel concentrate containing a nickel content enriched by a factor of up to 5 and an iron content reduced down to as low as 1 wt. % the nickel concentrate. In an exemplary implementation, winning the nickel concentrate from the first pulp may include obtaining the nickel concentrate as a feed material for ferronickel smelting process. In addition, in an exemplary implementation, forming the second solid residue and the second leachate solution by ammoniacal leaching of either the nickel concentrate or the first solid residue with the ammoniacal solution may include obtaining a nickel-rich solution containing nickel ammine complexes by an atmospheric leaching at a temperature lower than 30° C. for a duration up to 4 hours using the ammoniacal solution. In an exemplary implementation, recovering the high-grade nickel including a nickel oxalate product with a grade of more than 97 wt % from the second leachate solution may include forming a first solid fraction and a first liquid fraction by heating the nickel-rich solution up to the boiling point, and obtaining a high-grade nickel by separating the first solid fraction from the first liquid fraction. In an exemplary implementation, the exemplary process to extract the high-grade nickel may further include producing a high-grade metallic or oxidic nickel product by thermally decomposing the high-grade nickel at a temperature above 340° C. In an exemplary implementation, recovering the high-grade nickel including a nickel oxalate product with the grade of more than 97 wt % from the second leachate solution may include recovering the high-grade nickel in submicron to nano-scale size. In an exemplary implementation, forming a first pulp including a first solid residue and a first leachate solution by acid leaching of the crushed non-sulfidic nickeliferous material including extracting more than 96% of iron present in the non-sulfidic nickeliferous material by leaching with an organic acid-based solution, the organic acid-based solution including an oxalic acid solution, may include forming the first leachate solution rich in iron (III) oxalate as a by-product. In an exemplary implementation, the exemplary process to extract the high-grade nickel from the at least one non-sulfidic nickeliferous material may further include exposing the first leachate solution to light irradiation, forming a second solid fraction and a second liquid fraction by precipitating iron (II) oxalate compound, separating the second solid fraction from the second liquid fraction, and obtaining a mixture of metallic and oxidic iron compound by thermally decomposing the second solid fraction at a temperature above 250° C. In an exemplary implementation, the exemplary process to extract a high-grade nickel from the at least one non-sulfidic nickeliferous material may further include regenerating oxalic acid by treating the first leachate solution with at least one alkali metal hydroxide.

In another general aspect, the present disclosure is directed to an exemplary process to extract nickel concentrate from at least one non-sulfidic nickeliferous material. In an exemplary implementation, the exemplary process may include reducing particle size of the at least one non-sulfidic nickeliferous material by crushing the at least one non-sulfidic nickeliferous material, wherein the at least one non-sulfidic nickeliferous material including at least one primary or secondary non-sulfidic iron-bearing nickeliferous resource in oxide, hydroxide, carbonate, and silicate forms, forming a first pulp including a first solid residue and a first leachate solution by acid leaching of the crushed non-sulfidic nickeliferous material, including extracting more than 96% of iron present in the non-sulfidic nickeliferous material by leaching, with a solution containing an organic acid-based solution and at least one reducing agent, the organic acid-based solution including an oxalic acid solution, wherein acid leaching may include an atmospheric acid leaching under a restricted light condition at a temperature lower than 95° C., for a duration lower than 10 hours, and recovering a nickel concentrate, including more than 85 wt % of nickel from the at least one non-sulfidic nickeliferous material, from the first pulp by winning may include physically separating coarse fraction of particles in the first pulp from fine fraction using one or more of wet sieve, hydrosizer, or hydrocyclone.

The above general aspect may have one or more of the following features. In an exemplary implementation, the at least one primary or secondary non-sulfidic iron-bearing nickeliferous resource may include chromite overburdens, poly-metallic sea nodules, and laterites particularly low-grade nickel laterite ores. In an exemplary implementation, forming a first pulp including a first solid residue and a first leachate solution by acid leaching of the crushed non-sulfidic nickeliferous material may include an atmospheric acid leaching under a restricted light condition at a temperature lower than 95° C., for a duration lower than 10 hours. In an exemplary implementation, the at least one reducing agent includes one or more of ascorbic acid, citric acid, hydrazine, and glucose. In addition, in an exemplary implementation, recovering the nickel concentrate, including more than 85 wt % of nickel from the at least one non-sulfidic nickeliferous material, from the first solid residue by winning may include recovering the nickel concentrate with a nickel content enriched by a factor of up to 4 and an iron content reduced down to as low as 5 wt. % contains iron (II) oxalate residue, the nickel concentrate may be a feed material for ferronickel smelting process. Furthermore, in an exemplary implementation, the exemplary process to extract the nickel concentrate may further include exposing the first leachate solution to light irradiation, the first leachate solution may include a solution rich in iron (III) oxalate as a by-product, forming a first solid fraction and a first liquid fraction by precipitating iron (II) oxalate compound, separating the first solid fraction from the first liquid fraction, and obtaining a mixture of metallic and oxidic iron compound by thermally decomposing the first solid fraction at a temperature above 250° C. In addition, in an exemplary implementation, the exemplary process to extract the nickel concentrate may further include regenerating oxalic acid by treating the first leachate solution with at least one alkali metal hydroxide.

BRIEF DESCRIPTION OF THE DRAWINGS

The drawing figures depict one or more implementations in accord with the present teachings, by way of example only, not by way of limitation. In the figures, like reference numerals refer to the same or similar elements.

DETAILED DESCRIPTION

Figure 1A:
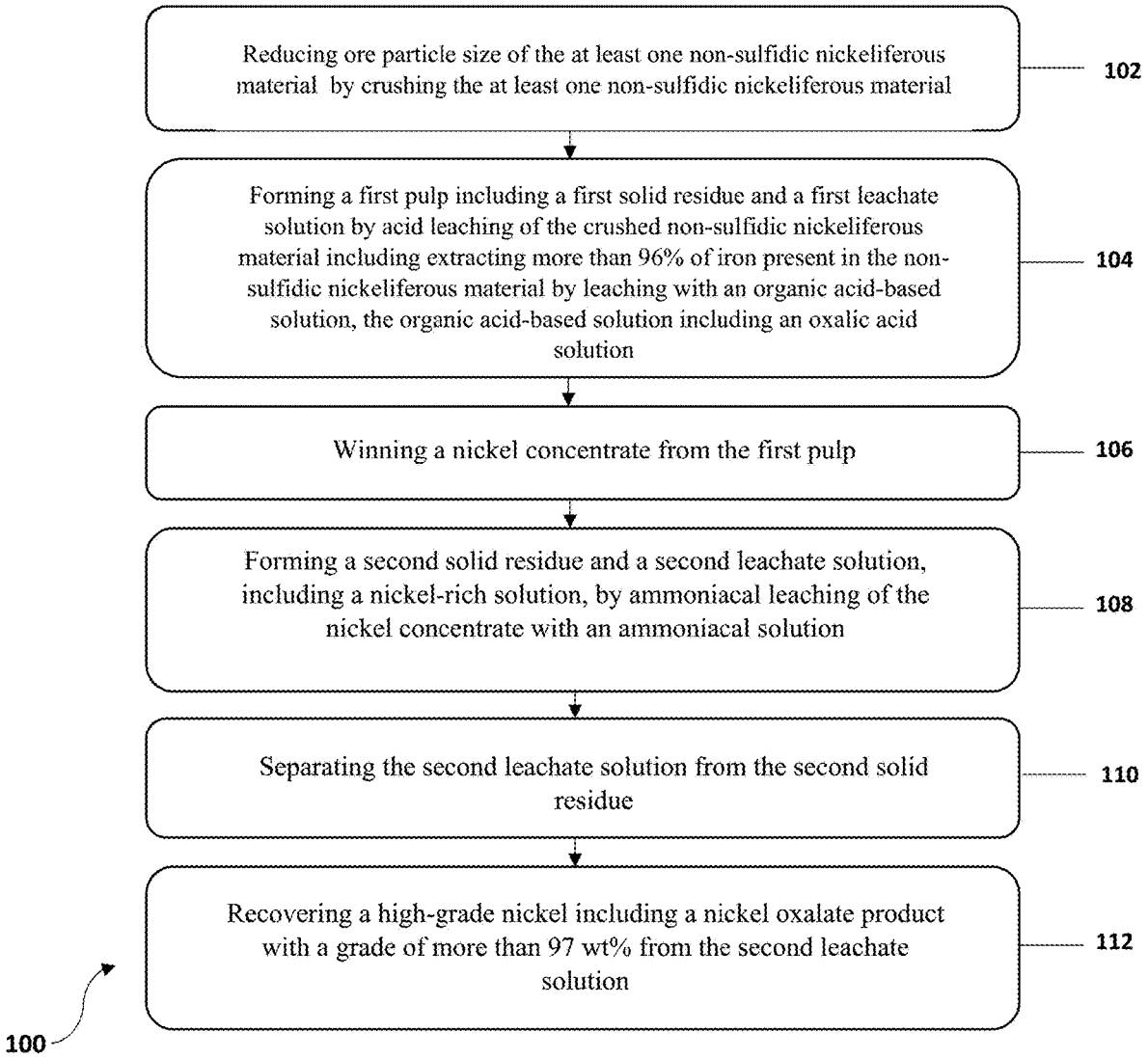
FIG. 1A illustrates a flowchart of an implementation of an extraction process including both physical and chemical separation processes to produce high-grade nickel products from non-sulfidic nickeliferous materials, consistent with one or more exemplary embodiments of the present disclosure.

In the following detailed description, numerous specific details are set forth by way of examples in order to provide a thorough understanding of the relevant teachings. However, it should be apparent that the present teachings may be practiced without such details. In other instances, well-known methods, procedures, components, and/or circuitry have been described at a relatively high-level, without detail, in order to avoid unnecessarily obscuring aspects of the present teachings. The following detailed description is, therefore, not to be taken in a limiting sense, and the scope of the present disclosure is defined only by the appended claims.

Features of an exemplary process is utilizing an efficient extraction process based on two main leaching steps under the atmospheric pressure including oxalic acid-based leaching and ammoniacal leaching to extract a high-grade nickel product such as nickel oxalate, nickel oxide, and metallic nickel. Some benefits from utilizing exemplary processes and methods described within the present disclosure may include, but are not limited to, developing an effective process to be applicable for recovering a high-grade nickel product from at least one non-sulfidic nickeliferous resource including primary or secondary non-sulfidic iron-bearing nickeliferous resources in oxide, hydroxide, carbonate, and silicate forms. The primary or secondary non-sulfidic iron-bearing nickeliferous resources may include chromite overburdens, poly-metallic sea nodules, and laterites-particularly low-grade nickel laterite ores with nickel content lower than 1 wt %.

As a functional feature, an exemplary extraction process may be implemented in two modes-slow and accelerated mode resulting in the production of the high-grade nickel and a nickel concentrate, respectively.

In an exemplary embodiment, an exemplary process may successfully utilize the selective iron (III) leachability along with the nickel insolubility in oxalic acid solutions for nickel upgrading in the non-sulfidic nickel resources. Although nickel precipitation in the form of nickel oxalate may restrict the use of oxalic acid in hydrometallurgical processes of non-sulfidic nickel resources to bring nickel into solution, this feature may be effectively used to enrich nickel in the solid residue and make nickel laterites exploitable for the recovery of high-grade nickel compounds.

In an exemplary embodiment, the produced nickel concentrate in an exemplary extraction process may be further used in the ferronickel smelting process in terms of its suitable Fe/Ni ratio as well as the nickel grade that may be a practical advantage of the present extraction process.

In an exemplary embodiment, iron oxalate compound production with an overall iron recovery of about 97% may be another advantage of an exemplary extraction process since the efficient utilization of the oxalic acid consumed in the extraction process may be provided through the production of iron (III) oxalate solution as the by-product. In this way, the cost of the oxalic acid consumption may be partly compensated. Iron (III) oxalate solution may be used directly or in powder form by evaporation. Iron (III) oxalate compound may be further processed for use as a catalyst, for use in the printing industry or for producing goldish color in the anodizing process of aluminum. Further processing of iron (III) oxalate solution to iron (II) oxalate may be applicable as a photographic developer, as a pigment in the color, polymer, and glass industry, as well as, an iron fertilizer in agriculture.

In an exemplary embodiment, as an economic feature, an exemplary extraction process may provide regenerating of the consumed oxalic acid and recycling evaporated ammonia, and water in the process in the form of iron (III/II) oxalate by-products, ammonia solution, or utility water, respectively. Moreover, in an exemplary embodiment, the consumed oxalic acid may be recovered as alkali oxalates which may be further utilized to regenerate oxalic acid by well-known processes.

In an exemplary embodiment, aspects and features in an exemplary concentration of non-sulfidic iron-bearing nickeliferous resources such as chromite overburdens, poly-metallic sea nodules, and laterites particularly low-grade nickel laterite ore with nickel content lower than 1 wt %, followed by extraction of high-grade nickel product based on the two main leaching step at atmospheric condition as well as production of the beneficial by-product of iron oxalate compound and alkali oxalate salts by consideration of the selective leachability of iron (III) oxides/hydroxides in oxalic acid besides the insolubility of nickel oxalate will be described in greater detail.

In an exemplary embodiment, physicochemical properties, elemental analysis and morphology of an exemplary high-grade nickel product, an exemplary nickel concentrate and an exemplary iron by-product may be evaluated and described in more detail in connection with specific exemplary implementations of the present disclosure.

High-Grade Nickel Recovery from Non-Sulfidic Nickeliferous Materials

In laterite ores, nickel is associated with highly crystalline iron oxide/hydroxides or with silicates in the form of solid solution that make it very difficult to selectively concentrate and recover nickel from such resources employing conventional metallurgical processes. Oxalic acid may selectively dissolve the host iron (III) oxides/hydroxide such as goethite through two main mechanisms that may occur separately or simultaneously involving displacement of ferric ions by hydrogen ions and sequestering ferric ions into the soluble metal-ligand complexes by chelation. The released nickel ions may be gradually precipitated by oxalate chelating to form nickel oxalate complex with low solubility in the aqueous solution leading to the formation of nickel oxalate dihydrate. The concentration of nickel from non-sulfidic nickeliferous resources including primary or secondary non-sulfidic iron-bearing nickeliferous materials in oxide, hydroxide, carbonate and silicate forms, such as, but not limited to, laterites, chromite overburdens, and poly-metallic sea nodules, is still unresolved. In an exemplary extraction process, the difference in the solubility of iron (Ill) oxalate and nickel oxalate may be employed as a basis for nickel upgrading in non-sulfidic iron-bearing nickeliferous resources particularly in laterite ores to produce the nickel concentrate for use in the high-grade nickel extraction or use in the subsequent metallurgical processes such as the ferronickel smelting process.

In an exemplary embodiment, FIG. 1A illustrates an exemplary flowchart of a general representation of the extraction process 100 to produce a high-grade nickel using both physical and chemical separation processes, consistent with one or more exemplary embodiments of the present disclosure. As illustrated in FIG. 1A, the exemplary extraction process may include reducing ore particle size of the at least one non-sulfidic nickeliferous material by crushing the at least one non-sulfidic nickeliferous material (step 102), forming a first pulp including a first solid residue and a first leachate solution by acid leaching of the crushed non-sulfidic nickeliferous material including extracting more than 96% of iron present in the non-sulfidic nickeliferous material by leaching with an organic acid-based solution, the organic acid-based solution including an oxalic acid solution (step 104), winning a nickel concentrate from the first pulp (step 106), forming a second leachate solution, including a nickel-rich solution, and a second solid residue by ammoniacal leaching of the nickel concentrate with an ammoniacal solution (step 108), separating the second leachate solution from the second solid residue (step 110), and recovering a high-grade nickel including a nickel oxalate product with a grade of more than 97 wt % from the second leachate solution (step 112). After reducing ore particle size of the at least one non-sulfidic nickeliferous material by crushing in step 102, forming the first pulp by acid leaching in step 104 may include entering the crushed material into an acid leaching tank along with hot oxalic acid solution to carry out the dissolution of iron and liberation-precipitation of nickel under the atmospheric pressure. The atmospheric acid leaching in step 104 may be performed at a temperature lower than 90° C., preferably 50-90° C. for a duration more than 20 hours, preferably 20-60 hours under a restricted light condition. In step 104, the concentration of oxalic acid may be adjusted for dissolution of iron (III) oxides and iron hydroxides as the main component and the host mineral of nickel. Winning a nickel concentrate from the first pulp in step 106 may include separating coarse fraction of ore particles in the first pulp from fine fraction by passing through a size classification including, for example, wet sieve, hydrosizer, or hydrocyclone. In step 106, the resulting solid coarse fraction may be free from nickel and it is the process tailing. In an exemplary extraction process, the process tailing may be mostly composed of silica that is benign and may be safely disposed to the environment. In step 106, the resulting fine fraction in which nickel oxalate may be accumulated may be considered as a nickel concentrate for further processing in the ferronickel smelting process, considering its suitable Fe:Ni ratio. The nickel concentrate in step 106 may contain a nickel content enriched by a factor of up to 5 and an iron content reduced to a desired level down to as low as 1 wt. %. The finer the fraction separated, the higher the nickel grade in the concentrate. In an exemplary embodiment, the suitable Fe/Ni ratio in ferronickel smelting may be about 5-12 depending on the gangue minerals. The less the ratio, the higher is the grade of the produced FeNi alloy. Forming a second leachate solution including a nickel-rich solution, and a second solid residue by ammoniacal leaching of the nickel concentrate with an ammoniacal solution in step 108 may include entering the fine fraction into an ammoniacal leaching tank and mixing with the ammoniacal solution to selectively dissolve nickel oxalate.

Figure 1B:
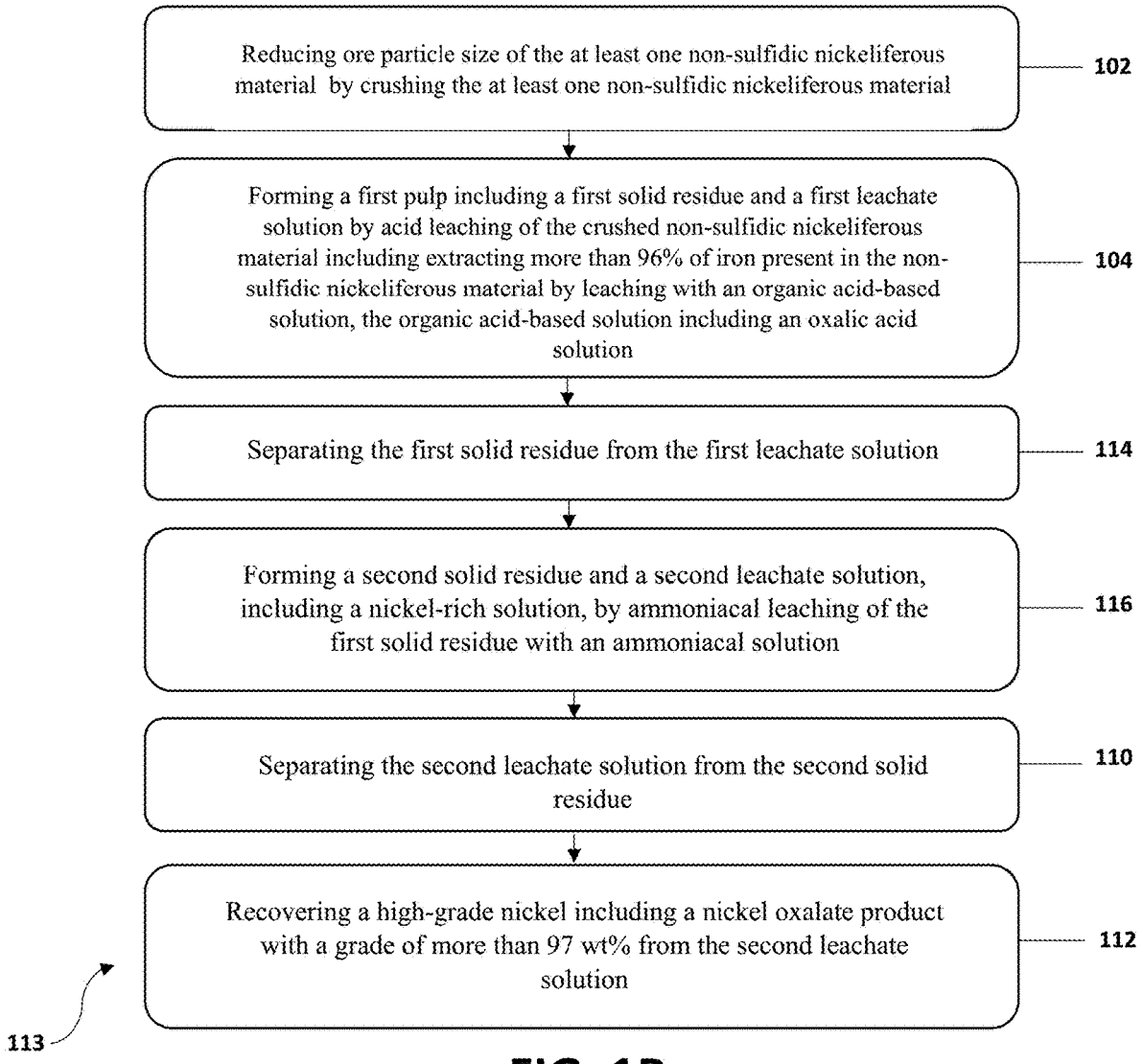
FIG. 1B illustrates a flowchart of an implementation of an extraction process to produce high-grade nickel products without utilizing a size separation process, consistent with one or more exemplary embodiments of the present disclosure.

In an exemplary embodiment, FIG. 1B illustrates a flowchart of an implementation of the extraction process 113 to produce high-grade nickel products without utilizing a size separation process, consistent with one or more exemplary embodiments of the present disclosure.

As illustrated in FIG. 1B, the exemplary extraction process 113 may include reducing ore particle size of the at least one non-sulfidic nickeliferous material by crushing the at least one non-sulfidic nickeliferous material (step 102), forming a first pulp including a first solid residue and a first leachate solution by acid leaching of the crushed non-sulfidic nickeliferous material including extracting more than 96% of iron present in the non-sulfidic nickeliferous material by leaching with an organic acid-based solution, the organic acid-based solution including an oxalic acid solution (step 104), separating the first solid residue from the first leachate solution (step 114), forming a second solid residue and a second leachate solution, including a nickel-rich solution, by ammoniacal leaching of the first solid residue with an ammoniacal solution (step 116), separating the second leachate solution from the second solid residue (step 110), and recovering a high-grade nickel including a nickel oxalate product with a grade of more than 97 wt % from the second leachate solution (step 112). In an exemplary extraction process, the first pulp including a first solid residue and a first leachate solution may directly be chemically treated with the ammoniacal solution in step 116, without using the size classification in step 106, by applying an exemplary flowchart 113 shown in FIG. 1B.

Figure 1C:
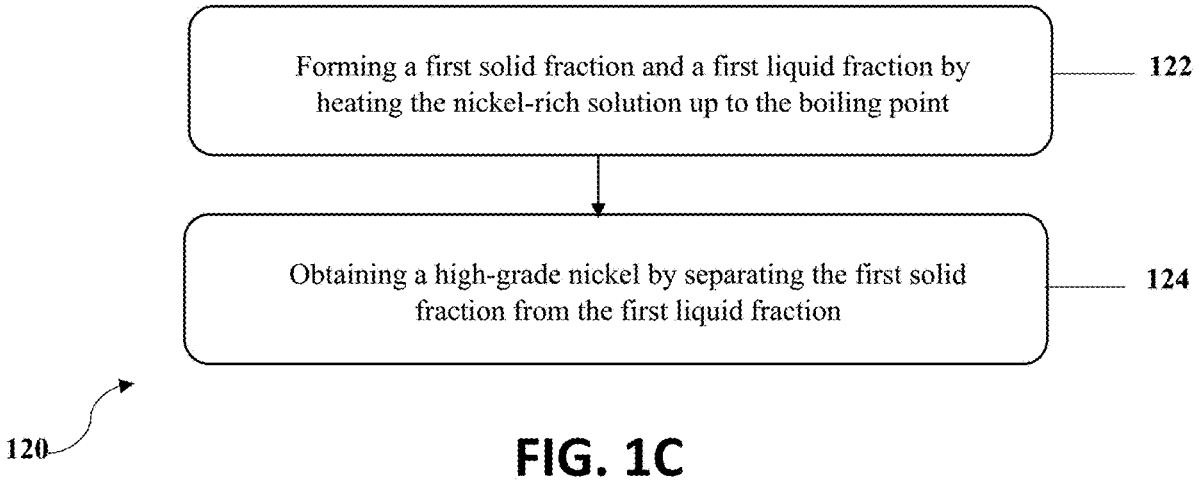
FIG. 1C illustrates a flowchart of an implementation of recovering high-grade nickel, consistent with one or more exemplary embodiments of the present disclosure.

In an exemplary embodiment, FIG. 1C illustrates a flowchart of an implementation of the recovering high-grade nickel 120, consistent with one or more exemplary embodiments of the present disclosure, after separating the second leachate solution including the nickel-rich solution, from the second solid residue in step 110, recovering high-grade nickel 120 may be performed as shown in FIG. 1C. As illustrated in FIG. 1C, the exemplary recovering high-grade nickel 120 may include forming a first solid fraction and a first liquid fraction by heating the nickel-rich solution up to the boiling point (step 122) and obtaining the high-grade nickel by separating the first solid fraction from the first liquid fraction (step 124). In an exemplary process, heating the nickel-rich solution up to the boiling point in step 122 may release an ammonia vapor that may be recovered and recycled for use in the ammoniacal leaching in step 108. Also, the first liquid fraction in step 124 may contain mostly water and may be recycled to the ammoniacal leaching tank in step 108 to optimize the water consumption in the exemplary extraction process. In an exemplary process, the high-grade nickel in step 124 may include nickel oxalate that may be further converted to nickel oxide and metallic nickel product under a specific atmosphere and at a desired temperature for example at a temperature above 340° C. through the thermal decomposition.

Figure 1D:
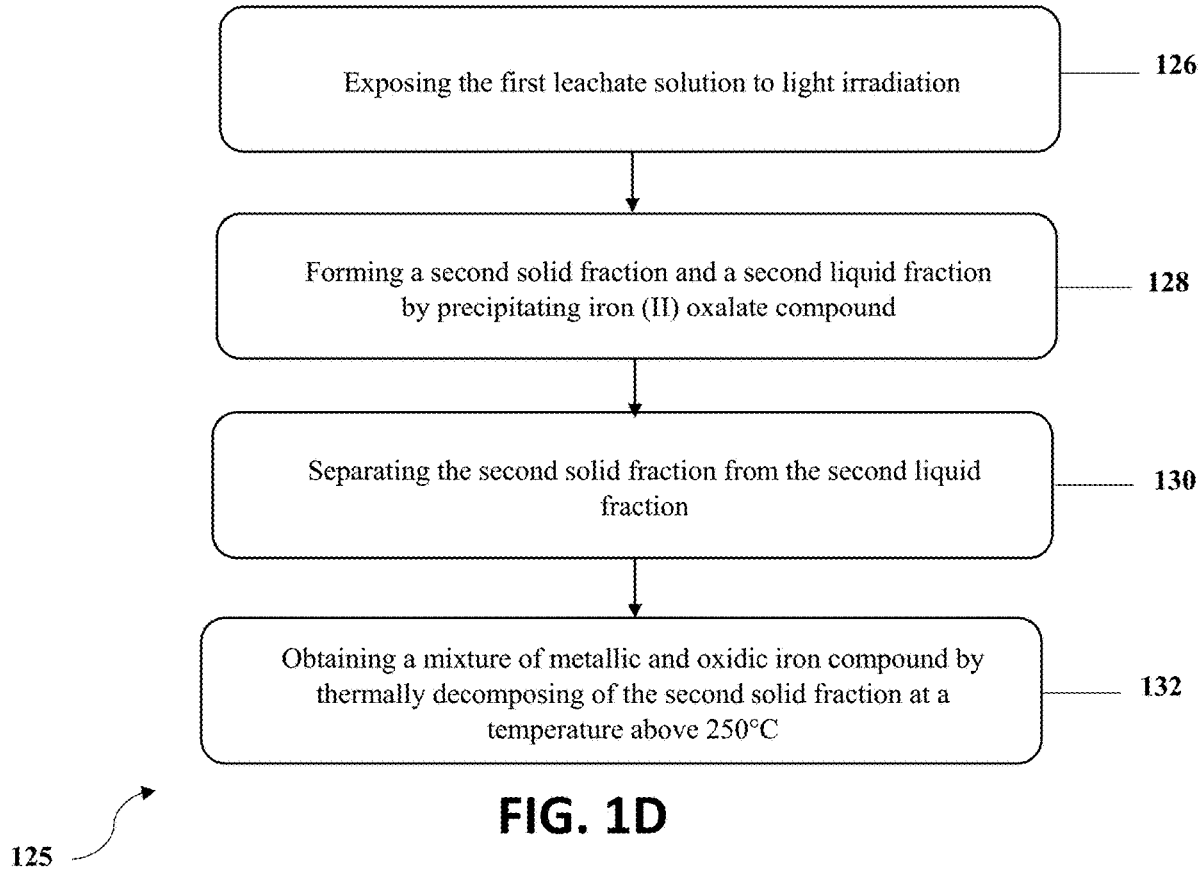
FIG. 1D illustrates a flowchart of an implementation of the iron recovery, consistent with one or more exemplary embodiments of the present disclosure.

In an exemplary embodiment, FIG. 1D illustrates a flowchart of an implementation of the iron recovery 125, consistent with one or more exemplary embodiments of the present disclosure. The first leachate solutions in step 102 may contain the high extents of iron in the form of an aqueous solution of iron (III) oxalate that may be one of the valuable by-products of the exemplary extraction process. In an exemplary process, the first leachate solution may be further processed through an exemplary evaporation to obtain a powder of iron (III) oxalate as a valuable by-product of the exemplary extraction process. As illustrated in FIG. 1D, the exemplary iron recovery 125 may include exposing the first leachate solution to light irradiation (step 126), forming a second solid fraction and a second liquid fraction by precipitating iron (II) oxalate compound (step 128), separating the second solid fraction from the second liquid fraction (step 130), and obtaining a mixture of metallic iron and oxidic iron compound by thermally decomposing of the second solid fraction at a temperature above 250° C. (step 132). In an exemplary process, light irradiation in step 126 may include irradiating near-UV light and sunlight. Also, exposing the first leachate solution to light irradiation in step 126 may include a photochemical reduction which may result in the precipitation of crystalline iron (II) oxalate dihydrate and releasing carbon dioxide. In an exemplary process, the second liquid fraction in step 128 may contain mostly water and it may be recycled to the acid leaching tank in step 104 to optimize the water consumption in the exemplary extraction process.

Figure 2:
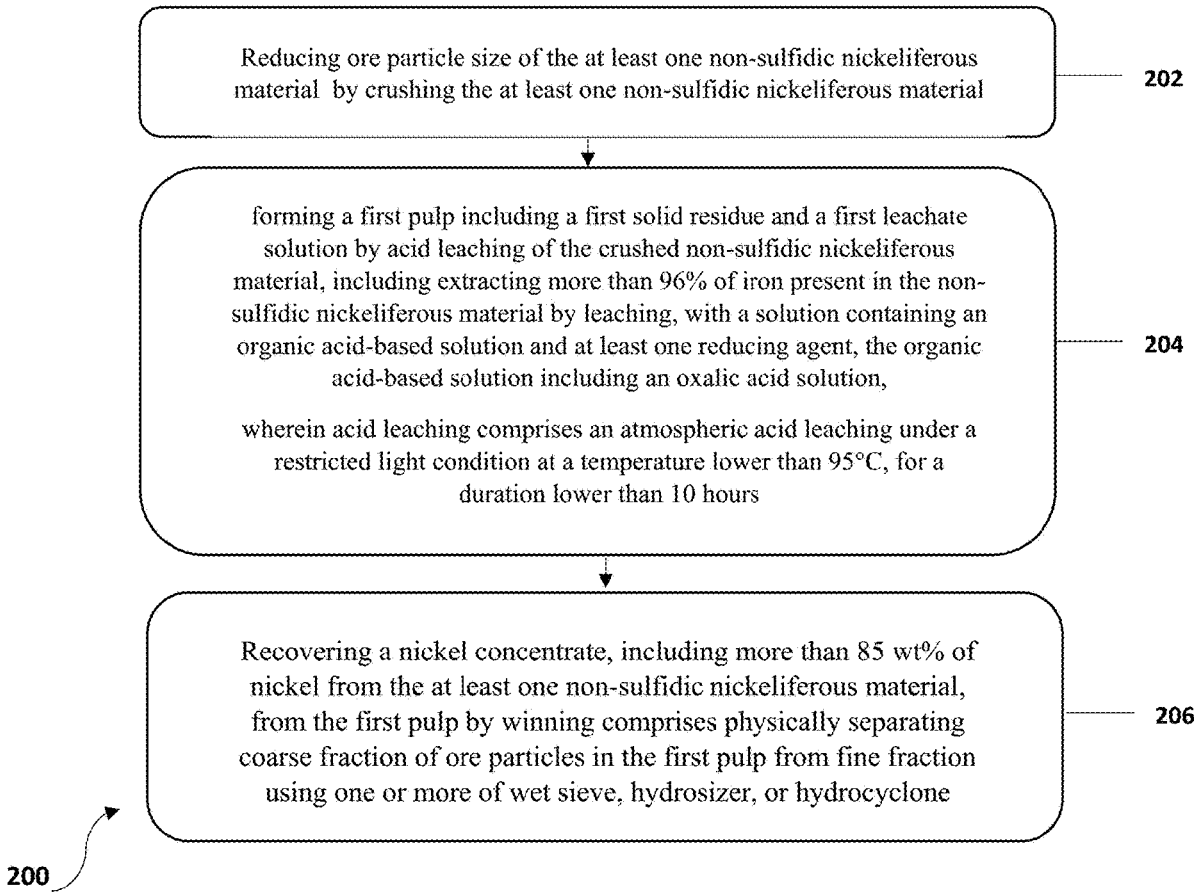
FIG. 2 illustrates a flowchart of an implementation of an extraction process to produce nickel concentrate from the non-sulfidic nickeliferous materials, consistent with one or more exemplary embodiments of the present disclosure.

In an exemplary embodiment, FIG. 2 illustrates a flowchart of an implementation of the extraction process 200 to produce nickel concentrate from the non-sulfidic nickeliferous materials, consistent with one or more exemplary embodiments of the present disclosure. As illustrated in FIG. 2, the exemplary extraction process 200 may include reducing ore particle size of the at least one non-sulfidic nickeliferous material by crushing the at least one non-sulfidic nickeliferous material (step 202), forming a first pulp including a first solid residue and a first leachate solution by acid leaching of the crushed non-sulfidic nickeliferous material, including extracting more than 96% of iron present in the non-sulfidic nickeliferous material by leaching, with a solution containing an organic acid-based solution and at least one reducing agent such as but not limited to ascorbic acid, citric acid, hydrazine, and glucose, the organic acid-based solution including an oxalic acid solution (step 204), and recovering a nickel concentrate, including more than 85 wt % of nickel from the at least one non-sulfidic nickeliferous material, from the first pulp by winning includes physically separating coarse fraction of ore particles in the first pulp from fine fraction using one or more of wet sieve, hydrosizer, or hydrocyclone (step 206). The atmospheric acid leaching in step 204 may be performed at a temperature lower than 95° C., preferably 80-95° C. for a duration lower than 10 hours, preferably 4-10 hours under a restricted light condition. In an exemplary process, the fine fraction in step 206 may be rich in nickel. Also, the resulting coarse fraction in step 206 may be free from nickel and it may be a process tailing. In addition, the process tailing in step 206 may be mostly composed of silica that is benign and may be safely disposed to the environment. In an exemplary process, the nickel concentrate in step 206 may also be utilized as a feed material for ferronickel smelters. In an exemplary process, the nickel concentrate in step 206 may contain a nickel content enriched by a factor of up to 4 and an iron content reduced down to 5 wt. %. The finer the fraction separated, the higher the nickel grade in the concentrate. The suitable Fe/Ni ratio in ferronickel smelting may be about 5-12 depending on the gangue minerals. The less the ratio, the higher is the grade of the produced FeNi alloy. In an exemplary process, the first leachate solution obtained by acid leaching in step 204 may be further treated with at least one alkali metal hydroxide to regenerate the oxalic acid. In an exemplary process, the first leachate solution obtained by acid leaching in step 204, may be further processed as shown in FIG. 1D.

An exemplary embodiment of a process for concentration and extraction of nickel from non-sulfidic nickeliferous resources is described below:

Crushing of the Non-Sulfidic Nickeliferous Material

In an exemplary embodiment, the crushing of the at least one non-sulfidic nickeliferous material may be carried out by employing a crusher including, for example, a jaw crusher or a hammer mill crusher. The enrichment of nickel in the concentrate of the present process may be affected by the particle size of the crushed material. Although an excessive size reduction may enhance the kinetics of the leaching process, it may cause presence of a significant amount of gangue materials in the fine fraction of the leach residue which negatively affects the enrichment of nickel in the nickel concentrate. Therefore, the degree of size reduction may be optimized and controlled. In an exemplary implementation, the optimized average particle size of the crushed material may be about 2.8 mm.

In an exemplary embodiment, the non-sulfidic nickeliferous material may include at least one primary or secondary non-sulfidic iron-bearing nickeliferous material in oxide, hydroxide, carbonate, and silicate forms, such as, but not limited to, chromite overburdens, poly-metallic sea nodules, and laterites particularly low-grade nickel laterite ores.

Atmospheric Acid-Based Leaching

In an exemplary embodiment, atmospheric leaching of the crushed material may be carried out by the oxalic acid-based solution under a restricted light condition, resulting in the dissolution of iron and simultaneously liberation-precipitation of nickel to form fine nickel oxalate particles. The oxalic acid-based leaching constitutes the following simultaneous events:

Decreasing iron content of the crushed non-sulfidic nickeliferous material by dissolving iron (III) oxides/hydroxides in the crushed material such as laterite ore through the chelating mechanism that results in a solution of iron (III) oxalate. The dissolution reaction may be affected by light, particularly UV radiation, such that the mechanism changes into reductive leaching which leads to the precipitation of iron (II) oxalate, i.e., $FeC_2O_4.2H_2O$. Therefore, it me be necessary to control light conditions by masking the reaction vessel against light irradiation to prevent the premature transformation of soluble iron (III) oxalate to insoluble iron (II) oxalate.

Releasing the nickel values entrapped in the iron (III) oxides and iron (III) hydroxides and other lateritic minerals.

Precipitation of the liberated nickel as fine independent oxalate particles by reacting with the free oxalate ligands.

In an exemplary embodiment, at the end of the leaching step, the resulting pulp may include a solid residue and a leachate solution. The solid residue may contain fine independent nickel oxalate particles. In addition, about 98 percent of the iron content in the non-sulfidic nickeliferous material may be decreased after acid-leaching step. After the acid-based leaching, a physical separation method may be carried out to separate the nickel concentrate. Further, a chemical separation method may be then applied to obtain the high-grade nickel product such as nickel oxalate dihydrate.

In an exemplary embodiment, acid-based leaching may be performed under stirring and at a temperature ranging from 50° C. to 90° C. and a time duration ranging from 20 hours to 60 hours.

In an exemplary embodiment, the amount of oxalic acid may be controlled to be enough to provide at least one to several times the stoichiometric amount of oxalic acid required for the dissolution reaction of iron oxide/hydroxides.

In an exemplary embodiment, dissolution of iron oxides and iron hydroxides may take place by the following reactions:

$$FeOOH_{(S)}+3H^{+}_{(aq)}=Fe^{3+}_{(aq)}+3/2H_2O_{(l)} \quad (1)$$

$$FeOOH_{(S)}+3H_2C_2O_{4(aq)}=Fe(C_2O_4)_3{}^{3+}_{(aq)}+H^{+}_{(aq)}+3/2H_2O_{(l)} \quad (2)$$

In an exemplary embodiment, atmospheric acid-based leaching may be conducted using metabolic oxalic acid.

In an exemplary embodiment, adding some controlled amount of a reducing agent to the oxalic acid-based leaching solution is carried out to accelerate nickel settlement and minimizing its loss in the solution, since the rate of nickel liberation may be higher than that of nickel precipitation, so the complete separation of nickel as the solid nickel oxalate dihydrate ($NiC_2O_4.2H_2O$) particles may be time-consuming. However, the addition of reducing agent may promote the reductive leaching of iron (III) oxides/hydroxides and may lead to the settlement of iron (II) oxalate in the solid residue. Thus, it may be necessary to control the amount of reducing agent to prevent the formation of solid iron (II) oxalate.

In an exemplary embodiment, acid-based leaching in the presence of a reducing agent may be performed under stirring and at a temperature ranging from 80° C. to 95° C. and a time duration ranging from 4 hours to 10 hours.

In an exemplary embodiment, the reducing agent may be one or more of ascorbic acid, citric acid, hydrazine, and glucose.

In an exemplary embodiment, the concentration of ascorbic acid may be in a range of 0-4 g/L.

Physical Separation

In an exemplary embodiment, winning a nickel concentrate may be achieved by separating the fine fraction of the solid residue in the resulting pulp using a size classifier including, for example, a wet sieve, hydrosizer, or hydrocyclone. The coarse fraction of the solid residue in the resulting pulp that may be almost free from nickel may be considered as the tailing of the process, and the fine fraction may be the nickel concentrate. The particle size of the crushed material may affect the enrichment factor of nickel resulting from the size separation step; the larger the particle size, the higher the nickel grade in the concentrate.

In an exemplary embodiment, the overall nickel recovery after physical separation may be about 84%.

In an exemplary embodiment, the nickel concentrate obtained in the presence of a reducing agent, may contain iron ranging from 10-15% and nickel ranging from 2.5% to 3%. While, without using any reducing agent, a nickel concentrate free from iron oxalate may be produced with a nickel content ranging from 3% to 3.5% and an iron content of lower than 5%. Therefore, utilizing a reducing agent as the reaction accelerator may cause some iron (II) oxalate precipitated in the concentrate with nickel oxalate that may limit further chemical separation processes such as ammoniacal leaching to produce a high-grade nickel product.

In an exemplary embodiment, the nickel concentrate may be used in the ferronickel smelting process.

Chemical Separation

In an exemplary embodiment, a specific chemical method (i.e. ammoniacal leaching) may be performed to extract a high-grade nickel product from the nickel concentrate obtained from the physical separation using an ammoniacal solution that may selectively dissolve nickel oxalate resulting in a purple-blue solution after filtration. The resulting leachate solution may contain nickel complexes such as $NH_3.NiC_2O_4.3H_2O$ or $2NH_3.NiC_2O_4.5H_2O$ according to the following dissolution reactions:

$$NiC_2O_4.2H_2O+NH_4OH=NH_3.NiC_2O_4.3H_2O \quad (3)$$

$$NiC_2O_4.2H_2O+2NH_4OH+H_2O=2NH_3.NiC_2O_4.5H_2O \quad (4)$$

Then, a blue-green powder of nickel oxalate dihydrate ($NiC_2O_4.2H_2O$) may be obtained through the heating and removing ammonia from the solution. Due to the low solubility in water, nickel oxalate may be precipitated by ammonia evaporation according to the following reactions:

$$NH_3.NiC_2O_4.3H_2O=NiC_2O_4.2H_2O\downarrow+NH_3\uparrow+H_2O \quad (5)$$

$$2NH_3.NiC_2O_4.5H_2O=NiC_2O_4.2H_2O\downarrow+2NH_3\downarrow+3H_2O \quad (6)$$

In an exemplary embodiment, ammoniacal leaching may be performed at a temperature ranging from 20° C. to 30° C. and a time duration ranging from 1 hours to 4 hours.

In an exemplary embodiment, the released hot ammonia vapor may be recovered through a gas scrubbing tower to dissolve ammonia in water and recycled for use in the ammoniacal leaching.

In an exemplary embodiment, the ammoniacal leaching may be performed either by using an aqueous ammoniacal solution or by purging ammonia gas into the ammoniacal leaching tank.

In an exemplary embodiment, the ammoniacal solution for dissolution of nickel oxalate in the nickel concentrate may be selected from ammonium oxalate solution or ammonia solution.

In an exemplary embodiment, the purity of the obtained nickel oxalate may be about 97% and the remaining may contain a little amount of cobalt oxalate and magnesium oxalate.

In an exemplary embodiment, if necessary, some impurity ions such as, but not limited to, cobalt and magnesium that along with nickel come into the nickel concentrate during the acid leaching step, may be removed and recovered from the nickel-rich solution obtained in the ammoniacal leaching step through a separation and purification method before heating and removing ammonia from the solution.

In an exemplary embodiment, the obtained high-grade nickel oxalate may exhibit desirable characteristics including, for example, the average particle size in nanometer-range and the rod-like morphology.

In an exemplary embodiment, high-grade nickel products with rod-like morphology as well as nanometer and sub-micrometer particle size may be obtained without using any additive, surface active agent, or template.

In an exemplary embodiment, the morphology of nickel oxalate particles may be controlled by adding an appropriate surfactant/surface active agent.

In an exemplary embodiment, high-grade nickel oxalate powder may be directly used as a precursor in catalyst and battery manufacturing.

In an exemplary embodiment, high-grade nickel oxalate powder may be further converted to metallic and oxidic nickel product by thermal decomposing at temperatures above 340° C. under air, inert, or reducing atmospheres.

Processing the by-Products

In an exemplary embodiment, production of iron (II/III) oxalate as a by-product may be one of the advantages of exemplary embodiments of the present disclosure since the consumed oxalic acid solution may be recovered in form of iron oxalate and alkali oxalate compounds. In an exemplary process, after leaching by oxalic acid and filtration, large amounts of iron (III) oxalate solution may be obtained that may be used directly or may be further processed to achieve iron (III) oxalate powder through water evaporation.

In an exemplary embodiment, iron (III) oxalate as a light-sensitive substance may be used as a catalyst and in the print industry. In addition, its derivative may be a very common compound used in the anodizing process of aluminum to impart a goldish color to the metal.

In an exemplary embodiment, the iron (III) oxalate solution may be exposed to the light irradiation such as, but not limited to, near UV-light or sunlight irradiation to precipitate iron (II) oxalate dihydrate crystals through a reductive photochemical reaction. Characteristics of the irradiated light such as intensity, depth, and angle as well as the concentration of the solution may be the effective parameters on the required time for precipitating iron (II) oxalate. The reductive precipitation of iron (II) oxalate continues as long as $CO_2$ bubbles are released. The liquid residue may be recycled to the acid leaching step. In other words, in an exemplary embodiment, after converting iron (III) oxalate to iron (I) oxalate in the solid form, the remaining solution that contains mostly water may be recycled to the acid leaching tank to reduce water consumption in an exemplary process.

In an exemplary embodiment, the reduction reaction of iron (III) oxalate compound to iron (II) oxalate compound may be conducted using a reducing agent such as, for example, ascorbic acid, citric acid, hydrazine, glucose, and any mixture thereof instead of light-irradiation.

In an exemplary embodiment, the iron (II) oxalate compound may be used as a photographic developer, a pigment in the glass, polymer, and paint industry, as well as, an iron fertilizer in agriculture.

In an exemplary embodiment, iron (II) oxalate may be converted to a mixture of metallic and oxide forms of iron by thermal decomposition at temperatures above 250° C. to produce iron/iron oxide fine particles.

In an exemplary embodiment, the purity of the produced iron oxalate compound may be about 92% and the remaining may contain a little amount of impurities including, for example, calcium oxalate, manganese oxalate, chromium oxalate, and magnesium oxalate.

In an exemplary embodiment, an overall iron recovery of about 97% may be achieved by processing the by-products in this disclosure.

In an exemplary embodiment, if necessary, some impurity ions such as, but not limited to, manganese, chromium and aluminum that along with iron come into solution during the acid leaching step, may be removed/recovered through a chemical precipitation method after completion of the photochemical reduction of iron (III) oxalate solution and before recycling the separated liquid to the acid leaching step.

In an exemplary embodiment, iron (III) oxalate solution may be treated with a stoichiometric amount of an alkali metal hydroxide, such as, but not limited to, NaOH, KOH, and any mixture of them to precipitate iron as $Fe(OH)_3$ and produce a sodium oxalate or potassium oxalate solution. Sodium oxalate or potassium oxalate may be easily crystalized as a solid by-product by evaporation. These alkali oxalates may be utilized to regenerate oxalic acid by well-known processes.

In an exemplary embodiment, the crystalline phase and crystallite size, the morphology and particle size, as well as, the elemental analysis of the high-grade nickel products, nickel concentrate, and iron by-products were assessed using characterization methods including, for example, X-ray diffraction (XRD), scanning electron microscopy (SEM), energy-dispersive X-ray spectroscopy (EDS), inductively coupled plasma-atomic emission spectroscopy (ICP-AES), X-ray fluorescence (XRF) and atomic absorption spectroscopy (AAS), as described in Examples below.

Example 1: High-Grade Nickel Extraction Through a Slow Leaching Process, Followed by a Physical/Chemical Separation In Example 1, a high-grade nickel extraction was carried out consistent with the teachings of the exemplary embodiments of the present disclosure. In this case, according to exemplary process 100 of FIG. 1A, a sample of nickel laterite, having the composition, shown in TABLE 1, containing 0.9% Ni and 27.3% Fe with Fe/Ni ratio of about 30 was crushed twice by jaw crusher and hammer mill to a particle size of less than 2.8 mm ($d_{50}$=300 μm). Acid leaching operation was carried out under the atmospheric pressure at a temperature of about 85° C. and in a 1-Liter batch glass reactor with a solid:liquid ratio of about 1:20, a stirring speed of about 500 rpm, and an oxalic acid concentration of about 1.25 M. An aluminum foil covered the glass reactor. After about 24 hours, the resulting pulp was passed through an ASTM 325 mesh sieve and then was filtered, washed, and dried. The product was a concentrate with about 4.1% Ni (equivalent to ~13% $NiC_2O_4.2H_2O$), about 1.1% Fe and with an overall nickel recovery of about 92%.

TABLE 1

| Chemical composition of the laterite ore sample (wt. %)[1] | | | | | | | | | | | | | | |
|---|---|---|---|---|---|---|---|---|---|---|---|---|---|---|
| Ni[2] | Fe[3] | Co[4] | Cr[4] | Mn[4] | $SiO_2$[4] | MgO[4] | CaO[4] | $Al_2O_3$[4] | $Na_2O$[4] | $K_2O$[4] | $SO_3$[4] | $TiO_2$[4] | $P_2O_5$[4] | L.O.I[4] |
| 0.93 | 27.31 | 0.15 | 2.54 | 0.23 | 36.76 | 4.77 | 3.07 | 4.02 | 0.22 | 0.15 | 0.31 | 0.10 | 0.03 | 7.37 |

[1]Trace amount of V, Cu, Zn, Sr and Zr was also detected.
[2]Nickel content was measured using the atomic absorption method.
[3]Iron content was measured by the spectroscopic method.
[4]Other elements were measured using XRF analysis.

The obtained concentrate may be used as the feed in the ferronickel smelting operations.

Moreover, if necessary, the iron content of the obtained concentrate may be increased to the desired value by adjusting the condition of light irradiation during or after the leaching.

In addition, due to the accumulation of nickel in the concentrate as the independent oxalate particles with specific chemical properties, it may be selectively separated using ammoniacal leaching operation. In this regard, the obtained nickel oxalate concentrate was treated with a 25% ammonia solution at a temperature of about 20° C. with a solid:liquid ratio of about 1:10 and stirring speed of about 400 rpm. After stirring for about 90 minutes, about 71% of nickel was dissolved in the ammonia solution. Utilizing exemplary process 120 of FIG. 1C, the solution was filtered and heated up to the boiling temperature to remove ammonia. Finally, about 97% of the dissolved nickel was precipitated as the nickel oxalate dihydrate powder, having the composition shown in TABLE 2., which was characterized after drying for 4 hours at about 95° C.

TABLE 2

| Chemical composition of nickel (II) oxalate (wt. %) | | | | | | | |
|---|---|---|---|---|---|---|---|
| | Elements | | | | | | |
| | Ni | Co | Mg | Mn | Cu | Zn | Fe |
| % | 31.19 | 0.59 | 0.18 | 0.03 | 0.02 | 0.01 | 0.00 |
| | Compounds | | | | | | |
| | $NiC_2O_4 \cdot 2H_2O$ | $CoC_2O_4 \cdot 2H_2O$ | $MgC_2O_4 \cdot H_2O$ | $MnC_2O_4 \cdot 2H_2O$ | $CuC_2O_4 \cdot 0.5H_2O$ | $ZnC_2O_4 \cdot 2H_2O$ | $FeC_2O_4 \cdot 2H_2O$ |
| % | 97.17 | 1.84 | 0.56 | 0.11 | 0.06 | 0.04 | |

Example 2: Producing Nickel Concentrate Through an Accelerated Leaching Process, Followed by a Physical Separation In Example 2, a nickel concentrate was produced pursuant to the teachings of the present disclosure. In this case, according to exemplary process 200 of FIG. 2, a sample of nickel laterite, having the composition shown in TABLE 1., containing 0.9% Ni and 27.3% Fe with Fe/Ni ratio of about 30 was crushed twice by jaw crusher and hammer mill to a particle size of less than 2.8 mm ($d_{50}$=300 μm). Acid leaching was conducted under the atmospheric pressure at a temperature of about 85° C. and in a 1-Liter glass reactor with a solid:liquid ratio of about 1:20, stirring speed of 400 rpm, an oxalic acid concentration of about 0.78 M, and an ascorbic acid concentration of about 2 g/L as a reducing agent/accelerator. The glass reactor was covered with aluminum foil. After about 7.5 hours, the resulting pulp was passed through an ASTM 325 mesh sieve and then was filtered, washed, and dried resulting in a concentrate, having the composition shown in TABLE 3, containing about 3.0% Ni and about 12.6% Fe with an overall nickel recovery of about 88%.

TABLE 3

Chemical composition of the nickel concentrate obtained through an accelerated leaching process followed by a physical separation (wt. %)

| Ni | Fe | Cu | Cr | Mn | Cu | Zn | $SiO_2$ | MgO | CaO | $Al_2O_3$ | $SO_3$ | $TiO_2$ | $K_2O$ | L.O.I |
|---|---|---|---|---|---|---|---|---|---|---|---|---|---|---|
| 3.00 | 12.61 | 0.15 | 0.90 | 0.21 | 0.04 | 0.06 | 29.83 | 2.98 | 3.49 | 2.44 | 0.04 | 0.10 | 0.17 | 36.28 |

The obtained nickel concentrate with Fe/Ni of about 4.2 may be a suitable feed for high-grade ferronickel production as recognized from TABLE 4.

TABLE 4

Feed characteristics of some ferronickel smelting operations in terms of Ni and Fe contents compared with those of the concentrate in the present application

| Smelters | Ni (wt. %) | Fe (wt. %) | Fe/Ni |
|---|---|---|---|
| Falcondo, Dominican Republic | 1.38 | 14.5 | 10.5 |
| Dniambo, New Caledonia | 2.70 | 13.0 | 4.8 |
| Cerro Motaso, Colombia | 2.20 | 15.3 | 7.0 |
| Concentrate in Example 1 | 4.1 | 1.1 | 0.26 |
| Concentrate in Example 2 | 3.0 | 12.6 | 4.2 |

Example 3: Processing the by-Products

One of the advantages of the present application may be the production of iron (II/III) oxalate. Utilizing exemplary process 125 as illustrated in FIG. 1D, 500 mL of iron (III) oxalate solution obtained from acid leaching operation (after filtration as described in detail in connection with Examples 1 and 2), was exposed to sunlight for about 6 hours to produce crystalline iron (II) oxalate dihydrate precipitate and finally 99.35% of iron precipitated through the following reactions:

$$Fe(C_2O_4)_3^{3+}{}_{(aq)}=Fe^{2+}{}_{(aq)}+2C_2O_4^{2-}{}_{(aq)}+CO_{2(g)} \quad (7)$$

$$Fe^{2+}{}_{(aq)}+2C_2O_4^{2-}{}_{(aq)}+2H_2O=FeC_2O_4.2H_2O_{(s)}\downarrow \quad (8)$$

After drying for about 4 hours at temperature of about 95° C., the obtained powder, having the composition shown in TABLE 5., consisted of about 92% $FeC_2O_4.2H_2O$ and the rest was a mixture of calcium, magnesium, manganese, and chromium oxalates and the remaining moisture in the powder.

TABLE 5

Chemical composition of iron (II) oxalate by-product (wt. %)

| | Elements | | | | |
|---|---|---|---|---|---|
| | Fe | Ca | Mg | Mn | Cr |
| % | 28.56 | 1.12 | 0.90 | 0.20 | 0.04 |

| | Compounds | | | | | |
|---|---|---|---|---|---|---|
| | $FeC_2O_4 \cdot 2H_2O$ | $CaC_2O_4 \cdot H_2O$ | $MgC_2O_4 \cdot H_2O$ | $MnC_2O_4 \cdot 2H_2O$ | $CrC_2O_4 \cdot H_2O$ | Total |
| % | 91.82 | 3.59 | 2.91 | 0.64 | 0.13 | 99.09 |

Example 4: Regeneration of Oxalic Acid

One of the advantages of exemplary embodiments of the present disclosure may be the possibility of oxalic acid regeneration from the leachate solution obtained from acid leaching step. In this regard, 500 mL of the iron (III) oxalate solution obtained from acid leaching operation (after filtration as described in connection with Examples 1 and 2) containing about 12 g/L ferric ion, with a pH of about 2.5, was treated with at least 12.9 g of sodium hydroxide (NaOH) under a restricted light condition to precipitate iron as ferric hydroxide and leaving sodium in the solution as a soluble oxalate salt according to the following reaction:

$$Fe_2(C_2O_4)_{3(aq)}+6NaOH_{(aq)}=2Fe(OH)_3\downarrow+3Na_2C_2O_{4(aq)} \quad (9)$$

The obtained sodium oxalate may be easily crystalized by evaporation and utilized to regenerate oxalic acid by the well-known processes.

Example 5: Material Characterization

In this example, the results of some characterization methods performed on the nickel-bearing material, nickel products as well as iron by-products (extracted/produced as described in detail in connection with Examples 1, 2, and 3) are presented.

Figure 3:
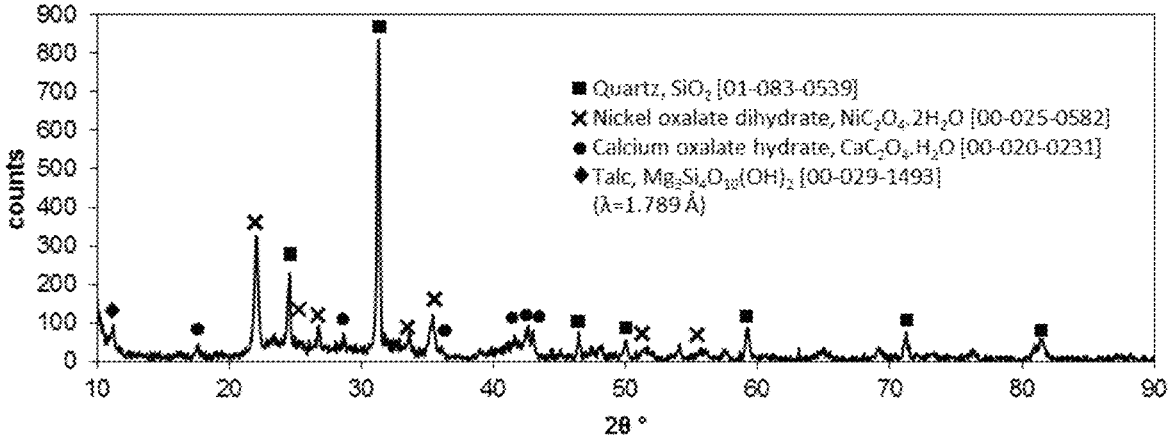
FIG. 3 illustrates an X-ray diffraction (XRD) pattern of an implementation of the nickel concentrate containing 3.2% Ni (i.e. about 10% $NiC_2O.2H_2O$) and 3.5% Fe, consistent with one or more exemplary embodiments of the present disclosure.

Referring to FIG. 3, X-ray diffraction (XRD) pattern of the concentrate containing 3.2% Ni and 3.5% Fe obtained after physical separation (i.e. size classification using mesh sieve) is illustrated, consistent with one or more exemplary embodiments of the present disclosure. The characteristic peaks of $NiC_2O_4.2H_2O$ in the XRD pattern of FIG. 3 confirm the presence of nickel in the form of oxalate salt. The concentrate is mainly consisting of quartz and some calcium oxalate is settled in it. The iron content is equivalent to 5.0% hematite but it is not detectable in the XRD pattern of FIG. 3.

Figure 4:
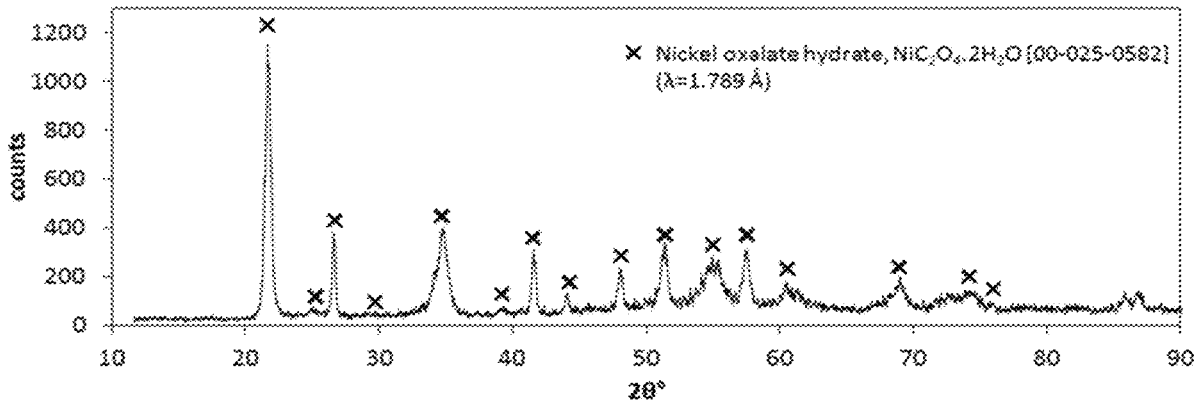
FIG. 4 illustrates an X-ray diffraction pattern of an implementation of the high-grade nickel oxalate powder obtained from ammoniacal leaching process, consistent with one or more exemplary embodiments of the present disclosure.

Referring now to FIG. 4, X-ray diffraction pattern of high-grade nickel (II) oxalate dihydrate obtained from chemical separation step is shown, consistent with one or more exemplary embodiments of the present disclosure. FIG. 4 reveals selective precipitation of nickel in the form of oxalate salt from the ammoniacal solution of the present disclosure.

Figure 5:
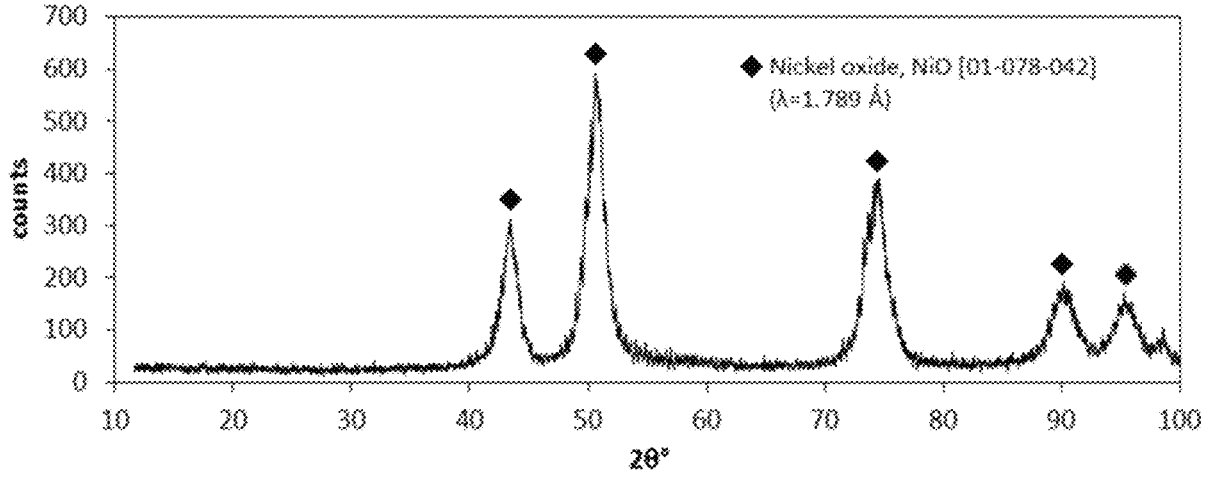
FIG. 5 illustrates an X-ray diffraction pattern of an implementation of the high-grade nickel oxide powder obtained by the thermal decomposition of the high-grade nickel oxalate powder at 380° C. in air atmosphere, consistent with one or more exemplary embodiments of the present disclosure.

FIG. 5 illustrates X-ray diffraction pattern of high-grade nickel oxide product produced via thermal decomposition of nickel oxalate powder, consistent with one or more exemplary embodiments of the present disclosure. Based on the Williamson-Hall method, the crystallite size of the nickel oxide powder was calculated to be about 10 nm.

Figure 6:
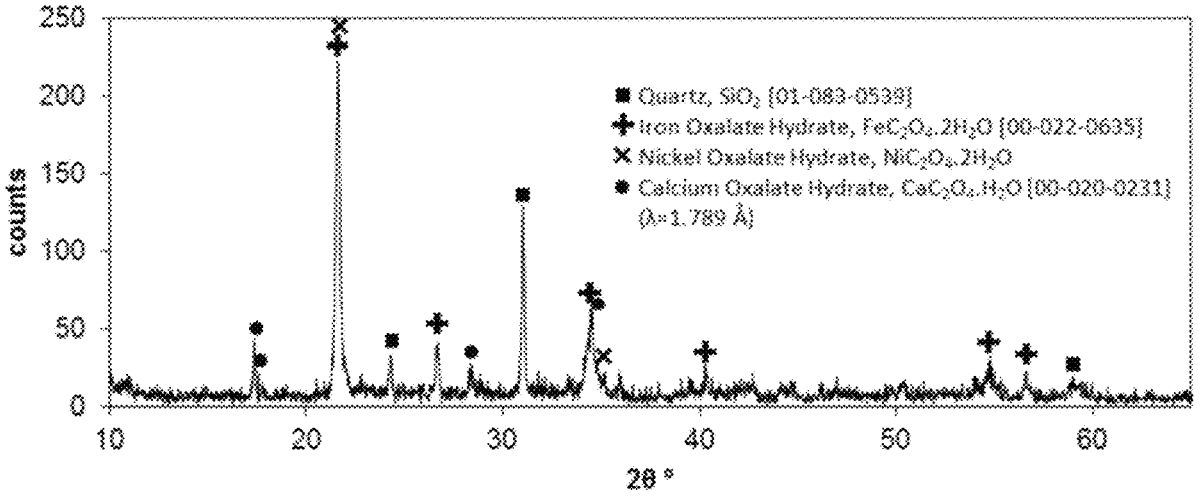
FIG. 6 illustrates an X-ray diffraction pattern of an implementation of the nickel concentrate product containing 3.0% Ni and 12.6% Fe, consistent with one or more exemplary embodiments of the present disclosure.

Referring next to FIG. 6, X-ray diffraction pattern of nickel concentrate is shown, consistent with one or more exemplary embodiments of the present disclosure. FIG. 6 indicates the presence of hydrated nickel oxalate, hydrated iron oxalate, quartz, and calcium oxalate crystalline phases as the main compounds in the nickel concentrate containing 3.0% Ni and 12.6% Fe.

Figure 7:
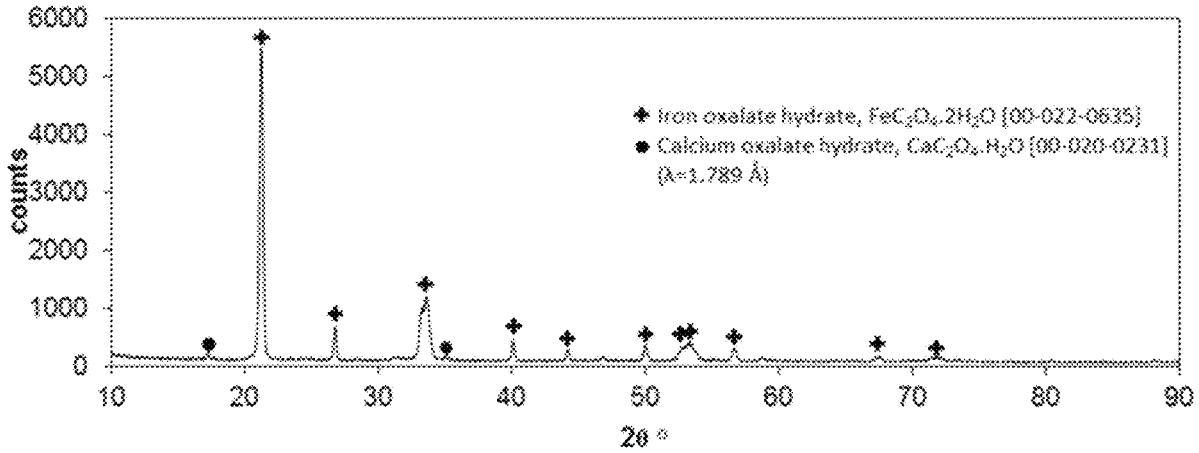
FIG. 7 illustrates an X-ray diffraction pattern of an implementation of the iron (II) oxalate powder obtained from the iron recovery process, consistent with one or more exemplary embodiments of the present disclosure.

Referring to FIG. 7, X-ray diffraction pattern of iron (II) oxalate by-product is illustrated, consistent with one or more exemplary embodiments of the present disclosure. As shown in FIG. 7, an only trace amount of calcium oxalate is detected that reveals the high grade of the produced iron oxalate compound in this application.

Figure 8:
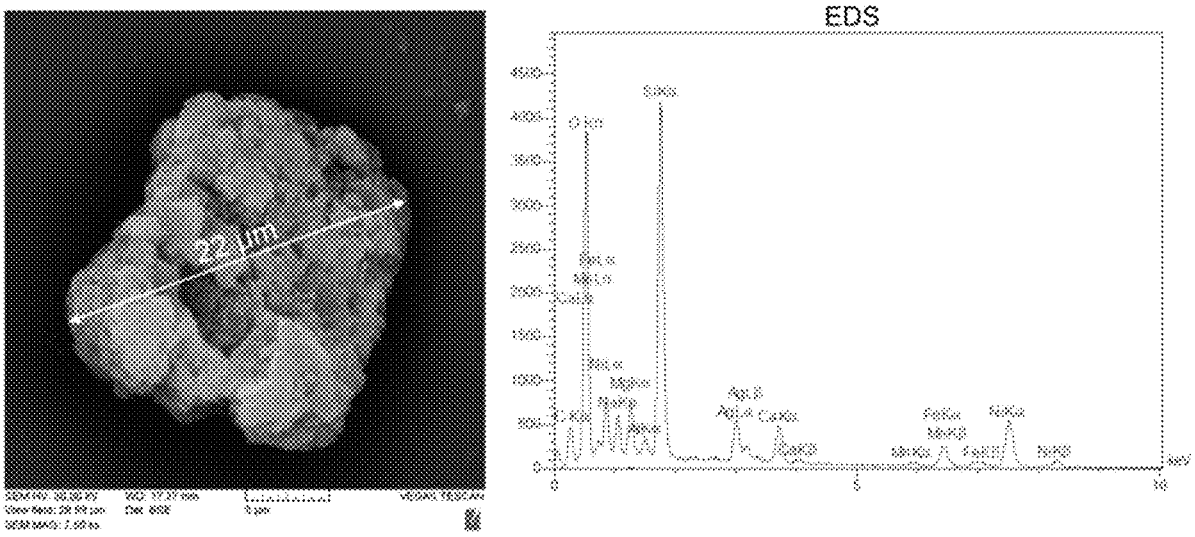
FIG. 8 shows a scanning electron microscope (SEM) image and an Energy-dispersive X-ray spectroscopy (EDS) of an implementation of the nickel oxalate aggregates in the concentrate, consistent with one or more exemplary embodiments of the present disclosure.

Referring next to FIG. 8, a scanning electron microscope (SEM) image along with an elemental analysis (EDS) of the nickel oxalate aggregates in the produced concentrate containing 3.2% Ni and 3.5% Fe are shown, consistent with one or more exemplary embodiments of the present disclosure.

Figure 9:
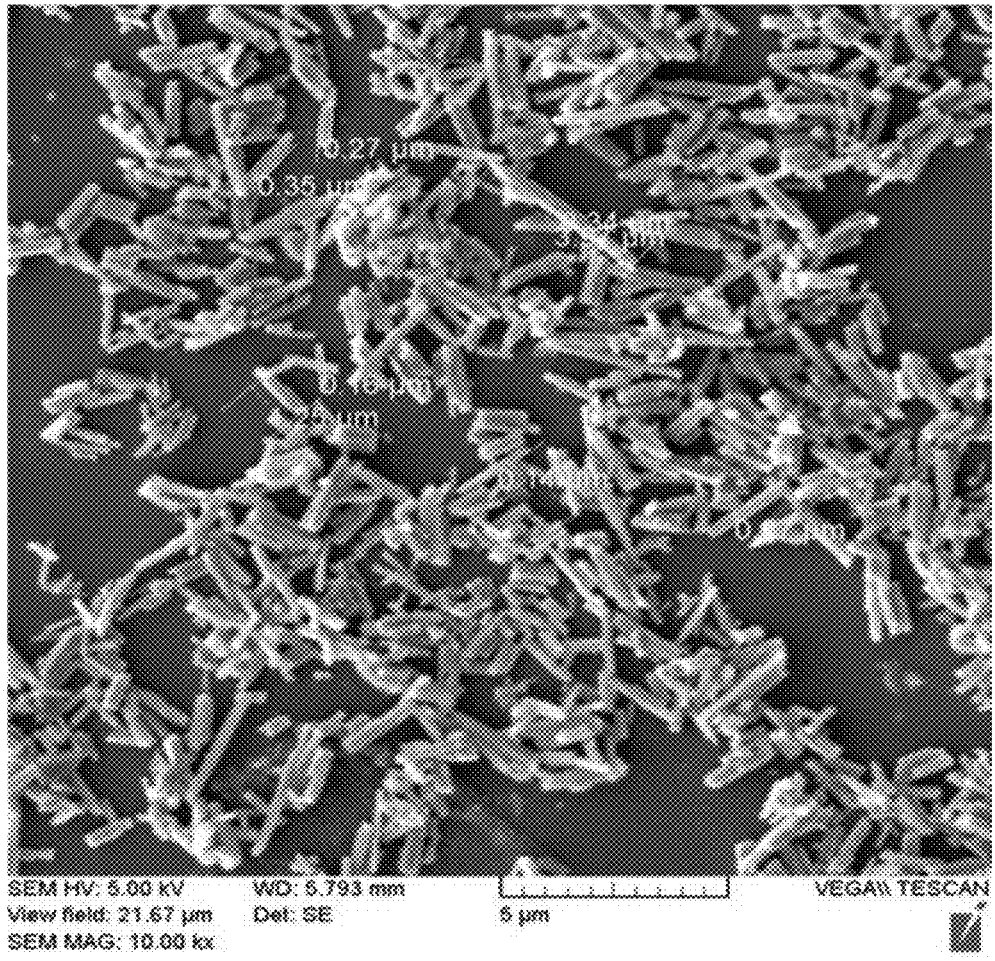
FIG. 9 shows a SEM image of an implementation of the high-grade nickel oxalate particles obtained from ammoniacal leaching process, consistent with one or more exemplary embodiments of the present disclosure.

In FIG. 9, a SEM image of the high-grade nickel oxalate produced through the ammoniacal leaching process is shown, consistent with one or more exemplary embodiments of the present disclosure. As illustrated in FIG. 9, the high-grade nickel oxalate particles exhibit a short rod-like morphology with a diameter of about 100-400 nm and a length of about 1-4 μm.

Figure 10:
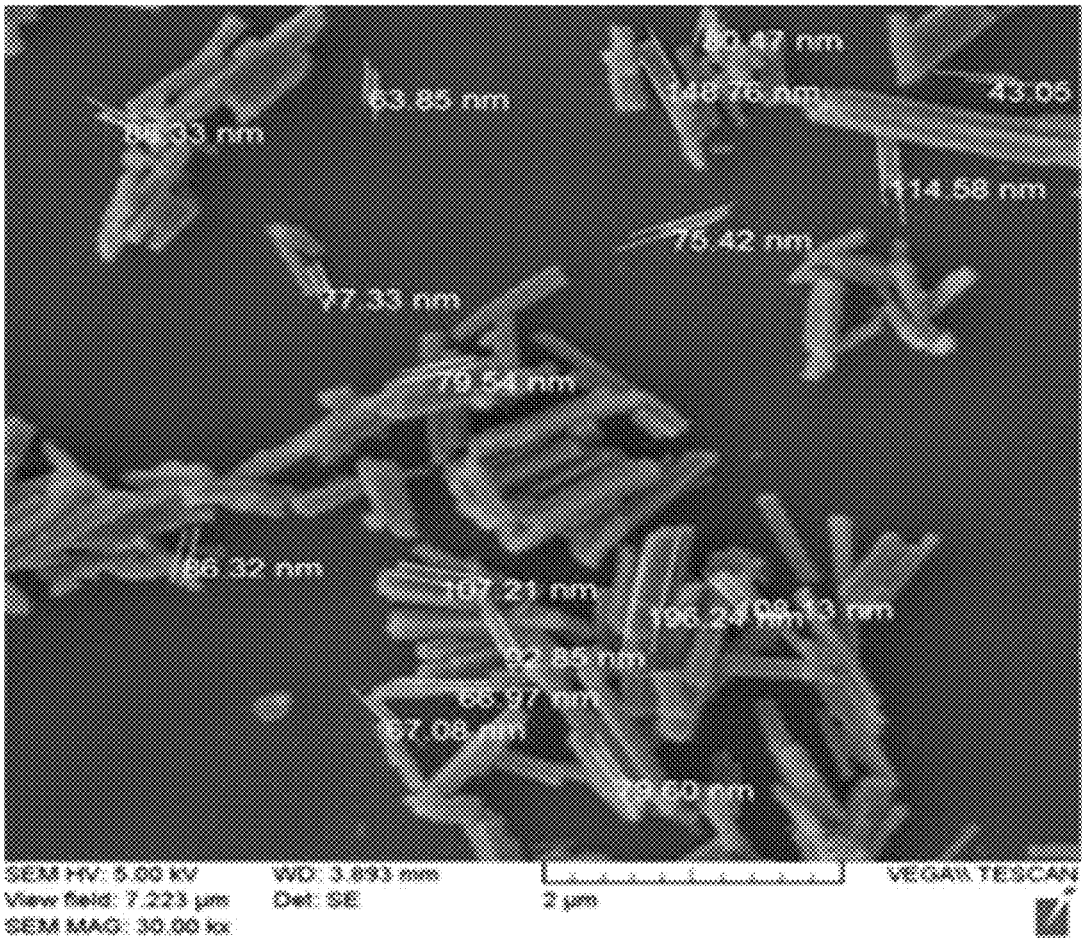
FIG. 10 shows a SEM image of an implementation of the high-grade nickel oxide particles obtained after thermal decomposition of the high-grade nickel oxalate powder, consistent with one or more exemplary embodiments of the present disclosure.

In FIG. 10, a SEM image of the high-grade nickel oxide particles produced through the thermal decomposition at 380° C. in air is illustrated, consistent with one or more exemplary embodiments of the present disclosure. As shown in FIG. 10, under thermal decomposition condition the rod-like nickel oxalate particles were contracted and converted to rod-like nickel oxide particles with a diameter of about 70-180 nm and a maximum length of about 2 m.

What is claimed is:

1. A process to extract a high-grade nickel from at least one non-sulfidic nickeliferous material comprising:

reducing particle size of the at least one non-sulfidic nickeliferous material by crushing the at least one non-sulfidic nickeliferous material, wherein the at least one non-sulfidic nickeliferous material including at least one primary or secondary non-sulfidic iron-bearing nickeliferous resource in oxide, hydroxide, carbonate, and silicate forms;

forming a first pulp including a first solid residue and a first leachate solution by acid leaching of the crushed non-sulfidic nickeliferous material including extracting more than 96% of iron present in the non-sulfidic nickeliferous material by leaching with an organic acid-based solution, the organic acid-based solution including an oxalic acid solution;

winning a nickel concentrate from the first pulp or separating the first solid residue from the first leachate solution;

forming a second solid residue and a second leachate solution by ammoniacal leaching of the nickel concentrate or the first solid residue with an ammoniacal solution, the second leachate solution including a nickel-rich solution;

separating the second leachate solution from the second solid residue; and recovering a high-grade nickel including a nickel oxalate product with a grade of more than 97 wt % from the second leachate solution, wherein forming the second solid residue and the second leachate solution by ammoniacal leaching of either the nickel concentrate or the first solid residue with the ammoniacal solution comprises obtaining a nickel-rich solution containing nickel ammine complexes by an atmospheric leaching at a temperature lower than 30° C. for a duration up to 4 hours using the ammoniacal solution.

2. The process of claim 1, wherein the at least one primary or secondary non-sulfidic iron-bearing nickeliferous material includes one or more of chromite overburdens, polymetallic sea nodules, and laterites, the laterites including nickel laterite ore.

3. The process of claim 1, wherein forming the first pulp including the first solid residue and the first leachate solution by acid leaching of the crushed non-sulfidic nickeliferous material includes:

extracting more than 96% of iron present in the non-sulfidic nickeliferous material by leaching with an organic acid-based solution, the organic acid-based solution including an oxalic acid solution; and an atmospheric acid leaching at a temperature lower than 90° C. for a duration more than 20 hours.

4. The process of claim 1, wherein winning the nickel concentrate from the first pulp comprises obtaining the nickel concentrate including more than 91 wt % of nickel from the at least one non-sulfidic nickeliferous material by physically separating coarse fraction of particles in the first pulp from fine fraction using one or more of wet sieve, hydrosizer, or hydrocyclone.

5. The process of claim 1, wherein winning the nickel concentrate from the first pulp comprises obtaining the nickel concentrate, including more than 91 wt % of nickel from the at least one non-sulfidic nickeliferous material, as an intermediate product free from iron (II) oxalate residue.

6. The process of claim 1, wherein winning the nickel concentrate from the first pulp comprises obtaining the nickel concentrates containing a nickel content enriched by a factor of up to 5 and an iron content reduced down to as low as 1 wt. % the nickel concentrate.

7. The process of claim 1, wherein winning the nickel concentrate from the first pulp comprises obtaining the nickel concentrate as a feed material for ferronickel smelting process.

8. The process of claim 1, wherein recovering the high-grade nickel including a nickel oxalate product with a grade of more than 97 wt % from the second leachate solution comprising:

forming a first solid fraction and a first liquid fraction by heating the nickel-rich solution up to the boiling point; and obtaining a high-grade nickel by separating the first solid fraction from the first liquid fraction.

9. The process of claim 1, further comprising producing a high-grade metallic or oxidic nickel product by thermally decomposing the nickel oxalate product at a temperature above 340° C.

10. The process of claim 1, wherein recovering the high-grade nickel including a nickel oxalate product with the grade of more than 97 wt % from the second leachate solution comprises recovering the high-grade nickel in sub-micron to nano-scale size.

11. The process of claim 1, wherein forming a first pulp including a first solid residue and a first leachate solution by acid leaching of the crushed non-sulfidic nickeliferous material including extracting more than 96% of iron present in the non-sulfidic nickeliferous material by leaching with an organic acid-based solution, the organic acid-based solution including an oxalic acid solution, comprises forming the first leachate solution rich in iron (III) oxalate as a by-product.

12. The process of claim 1, further comprising:

exposing the first leachate solution to light irradiation;

forming a second solid fraction and a second liquid fraction by precipitating iron (II) oxalate compound;

separating the second solid fraction from the second liquid fraction; and obtaining a mixture of metallic and oxidic iron compound by thermally decomposing the second solid fraction at a temperature above 250° C.

13. The process of claim 1, further comprising regenerating oxalic acid by treating the first leachate solution with at least one alkali metal hydroxide.

14. A process to extract a high-grade nickel from at least one non-sulfidic nickeliferous material comprising:

reducing particle size of the at least one non-sulfidic nickeliferous material by crushing the at least one non-sulfidic nickeliferous material, wherein the at least one non-sulfidic nickeliferous material including at least one primary or secondary non-sulfidic iron-bearing nickeliferous resource in oxide, hydroxide, carbonate, and silicate forms;

forming a first pulp including a first solid residue and a first leachate solution by acid leaching of the crushed non-sulfidic nickeliferous material including extracting more than 96% of iron present in the non-sulfidic nickeliferous material by leaching with an organic acid-based solution, the organic acid-based solution including an oxalic acid solution;

winning a nickel concentrate from the first pulp or separating the first solid residue from the first leachate solution;

forming a second solid residue and a second leachate solution by ammoniacal leaching of the nickel concentrate or the first solid residue with an ammoniacal solution, the second leachate solution including a nickel-rich solution;

separating the second leachate solution from the second solid residue;

recovering a high-grade nickel including a nickel oxalate product with a grade of more than 97 wt % from the second leachate solution;

exposing the first leachate solution to light irradiation;

forming a second solid fraction and a second liquid fraction by precipitating iron (II) oxalate compound;

separating the second solid fraction from the second liquid fraction; and obtaining a mixture of metallic and oxidic iron compound by thermally decomposing the second solid fraction at a temperature above 250° C.

15. A process to extract a high-grade nickel from at least one non-sulfidic nickeliferous material comprising:

reducing particle size of the at least one non-sulfidic nickeliferous material by crushing the at least one non-sulfidic nickeliferous material, wherein the at least one non-sulfidic nickeliferous material including at least one primary or secondary non-sulfidic iron-bearing nickeliferous resource in oxide, hydroxide, carbonate, and silicate forms;

forming a first pulp including a first solid residue and a first leachate solution by acid leaching of the crushed non-sulfidic nickeliferous material including extracting more than 96% of iron present in the non-sulfidic nickeliferous material by leaching with an organic acid-based solution, the organic acid-based solution including an oxalic acid solution;

winning a nickel concentrate from the first pulp or separating the first solid residue from the first leachate solution;

forming a second solid residue and a second leachate solution by ammoniacal leaching of the nickel concentrate or the first solid residue with an ammoniacal solution, the second leachate solution including a nickel-rich solution;

separating the second leachate solution from the second solid residue;

recovering a high-grade nickel including a nickel oxalate product with a grade of more than 97 wt % from the second leachate solution; and producing a high-grade metallic or oxidic nickel product by thermally decomposing the oxalate product at a temperature above 370° C.

16. The process of claim 15, wherein producing the high-grade metallic or oxidic nickel product by thermally decomposing the oxalate product at a temperature above 370° C. comprises thermally decomposing the oxalate product at 380° C.

17. The process of claim 15, further comprising:

exposing the first leachate solution to light irradiation;

forming a second solid fraction and a second liquid fraction by precipitating iron (II) oxalate compound;

separating the second solid fraction from the second liquid fraction; and obtaining a mixture of metallic and oxidic iron compound by thermally decomposing the second solid fraction at a temperature above 250° C.

18. The process of claim 15, wherein forming the first pulp including the first solid residue and the first leachate solution by acid leaching of the crushed non-sulfidic nickeliferous material includes:

extracting more than 96% of iron present in the non-sulfidic nickeliferous material by leaching with an organic acid-based solution, the organic acid-based solution including an oxalic acid solution; and an atmospheric acid leaching at a temperature lower than 90° C. for a duration more than 20 hours.

19. The process of claim 15, wherein winning the nickel concentrate from the first pulp comprises obtaining the nickel concentrate including more than 91 wt % of nickel from the at least one non-sulfidic nickeliferous material by physically separating coarse fraction of particles in the first pulp from fine fraction using one or more of wet sieve, hydrosizer, or hydrocyclone.

20. The process of claim 15, wherein recovering the high-grade nickel including a nickel oxalate product with a grade of more than 97 wt % from the second leachate solution comprising:

forming a first solid fraction and a first liquid fraction by heating the nickel-rich solution up to the boiling point; and obtaining a high-grade nickel by separating the first solid fraction from the first liquid fraction.

* * * * *